US007873302B2

(12) United States Patent
Kawakami et al.

(10) Patent No.: US 7,873,302 B2
(45) Date of Patent: Jan. 18, 2011

(54) CLEANING DEVICE AND IMAGE FORMING APPARATUS

(75) Inventors: Yoshihiro Kawakami, Hyogo (JP); Koji Kato, Ibaraki (JP); Hirobumi Ooyoshi, Ibaraki (JP); Tomofumi Yoshida, Ibaraki (JP); Kenzo Tatsumi, Osaka (JP); Yoshiyuki Shimizu, Osaka (JP); Tomohiro Kubota, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 403 days.

(21) Appl. No.: 11/957,782

(22) Filed: Dec. 17, 2007

(65) Prior Publication Data

US 2008/0152408 A1 Jun. 26, 2008

(30) Foreign Application Priority Data

Dec. 20, 2006 (JP) ..... 2006-342109

(51) Int. Cl.
*G03G 15/20* (2006.01)

(52) U.S. Cl. ..... 399/123; 399/102; 399/351; 15/256.51

(58) Field of Classification Search ..... 399/98, 399/102, 123, 350, 351, 358, 360; 15/256.5, 15/256.51, 256.52
See application file for complete search history.

(56) References Cited

U.S. PATENT DOCUMENTS 5,455,665 A * 10/1995 Baba et al. ..... 399/358
6,553,195 B2 * 4/2003 Korfhage et al. ..... 399/102

FOREIGN PATENT DOCUMENTS

| | | |
|---|---|---|
| JP | 10-301457 | 11/1998 |
| JP | 3126532 | 11/2000 |
| JP | 3245510 | 10/2001 |
| JP | 3440976 | 6/2003 |

OTHER PUBLICATIONS

U.S. Appl. No. 12/170,842, filed Jul. 10, 2008, Kubota, et al.
U.S. Appl. No. 12/257,547, filed Oct. 24, 2008, Kubota, et al.

* cited by examiner

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

A cleaning device includes a cleaning blade, a receiving member, an inlet seal, an adhering member, and an end seal. The cleaning blade is brought into contact with a photosensitive drum to remove residual toner therefrom. The receiving member receives the residual toner. The inlet seal guides the residual toner to the receiving member. The adhering member adheres the inlet seal to the receiving member. The end seal is arranged along the end portions of the cleaning blade and the inlet seal. The inlet seal covers the end seal and extends out from the end seal in its longitudinal direction.

17 Claims, 7 Drawing Sheets

CLEANING DEVICE AND IMAGE FORMING APPARATUS

CROSS-REFERENCE TO RELATED APPLICATIONS

The present application claims priority to and incorporates by reference the entire contents of Japanese priority document 2006-342109 filed in Japan on Dec. 20, 2006.

BACKGROUND OF THE INVENTION

1. Field of the Invention

The present invention relates to a cleaning device, a cleaning method, and an image forming apparatus.

2. Description of the Related Art

Commonly-used image forming apparatuses, such as a copier, a printer, a facsimile machine, and a printer, includes a detachable process cartridge. Such a process cartridge includes a latent image carrier, and at least one of a charging device, a developing device, and a cleaning device for forming an image on the latent image carrier.

Because the process cartridge is detachably attached to the main body of an image forming apparatus, it can be replaced with new one if necessary, and its maintenance need not be performed in a confined space inside the main body. A typical process cartridge rotatably supports a photosensitive drum as a latent image carrier, and includes a cleaning blade that removes residual toner from the photosensitive drum.

For example, Japanese Patent No. 3126532 discloses a conventional cleaning device that includes an inlet seal for guiding toner collected by a cleaning blade to a waste-toner container and an end seal for preventing the toner from leaking from the ends of the inlet seal and the cleaning blade. Japanese Patent No. 3245510 discloses another conventional cleaning device that includes an inlet seal provided upstream of a cleaning blade to guide toner to a waste-toner container. The inlet seal prevents toner from spilling out of the container with respect to the longitudinal direction of the cleaning blade.

In the conventional cleaning devices, the sealing member is arranged in such a manner as to be compressed by a photosensitive drum for sealing the gap between the photosensitive drum and the cleaning member, thereby preventing toner leakage. The sealing member also seals a gap at the ends of the cleaning blade and the inlet seal to prevent toner leakage therefrom. Because the thickness of the cleaning blade is about 1.2 millimeters to 2.0 millimeters, toner leakage from the end of the cleaning blade can be avoided simply by attaching the sealing member to the end of the blade. The inlet seal, however, has a thickness of 30 micrometers to 200 micrometers, and toner leakage therefrom cannot be prevented merely by attaching the sealing member to the end of the inlet seal. For this reason, the sealing member is compressed against the photosensitive drum to prevent the toner leakage from the end of the inlet seal.

The photosensitive drum repeats rotating and stopping operations. The highest line pressure acts on the end of the inlet seal when the photosensitive drum is rotating and stops rotating. The inlet seal, which is attached to the cleaning member with double-faced tape, gradually comes off due to the line pressure acting on its end as image forming operation is repeated. This causes toner leakage from the end of the inlet seal.

Such leaked toner may interfere the image forming operation and degrade the image quality. If this is not the case, the toner that is accumulated inside the image forming apparatus may impair the image appearance or cause a dust problem at the time of maintenance.

SUMMARY OF THE INVENTION

It is an object of the present invention to at least partially solve the problems in the conventional technology.

According to an aspect of the present invention, a cleaning device includes: an image carrier that is configured to be rotatable; a charging unit that uniformly charges a surface of the image carrier; an exposing unit that exposes the surface of the image carrier to patterning light to form an electrostatic latent image on the surface; a developing unit that develops the electrostatic latent image into a toner image; an intermediate transfer unit onto which the toner image is transferred from the surface of the image carrier; a cleaning unit that removes residual toner from the surface of the image carrier after the toner image is transferred from the surface; and a housing that houses the image carrier, and the charging unit, the exposing unit, the developing unit, the intermediate transfer unit, and the cleaning unit which are arranged around the image carrier to face the surface of the image carrier. The cleaning unit includes: a cleaning member that is brought into contact with the surface of the image carrier and removes the residual toner; a receiving member that receives the residual toner; a guiding member that guides the residual toner to the receiving member; an end member that is arranged around end portions of the cleaning member and the guiding member; and an adhering member that adheres the guiding member to the receiving member. The guiding member covers the end member, and extends out from the end member in a longitudinal direction of the guiding member.

According to another aspect of the present invention, a cleaning device includes: an image carrier that is configured to be rotatable; a charging unit that uniformly charges a surface of the image carrier; an exposing unit that exposes the surface of the image carrier to patterning light to form an electrostatic latent image on the surface; a developing unit that develops the electrostatic latent image into a toner image; an intermediate transfer unit onto which the toner image is transferred from the surface of the image carrier; a cleaning unit that removes residual toner from the surface of the image carrier after the toner image is transferred from the surface; and a housing that houses the image carrier, and the charging unit, the exposing unit, the developing unit, the intermediate transfer unit, and the cleaning unit which are arranged around the image carrier to face the surface of the image carrier. The cleaning unit includes: a cleaning member that is brought into contact with the surface of the image carrier and removes the residual toner; a receiving member that receives the residual toner; a guiding member that guides the residual toner to the receiving member; an end member that is arranged around end portions of the cleaning member and the guiding member; and an adhering member that adheres the guiding member and the end member to the receiving member. The guiding member covers the end member, and extends out from the end member in a longitudinal direction of the guiding member.

According to still another aspect of the present invention, an image forming apparatus includes: an image carrier that is configured to be rotatable; a charging unit that uniformly charges a surface of the image carrier; an exposing unit that exposes the surface of the image carrier to patterning light to form an electrostatic latent image on the surface; a developing unit that develops the electrostatic latent image into a toner image; an intermediate transfer unit onto which the toner image is transferred from the surface of the image carrier; a cleaning unit that removes residual toner from the surface of the image carrier after the toner image is transferred from the surface; and a housing that houses the image carrier, and the charging unit, the exposing unit, the developing unit, the intermediate transfer unit, and the cleaning unit which are arranged around the image carrier to face the surface of the image carrier. The cleaning unit includes: a cleaning member that is brought into contact with the surface of the image carrier and removes the residual toner; a receiving member that receives the residual toner; a guiding member that guides the residual toner to the receiving member; an end member that is arranged around end portions of the cleaning member and the guiding member; and an adhering member that adheres the guiding member to the receiving member. The guiding member covers the end member, and extends out from the end member in a longitudinal direction of the guiding member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

In the following, an image forming apparatus according to the embodiments is described as an electrophotographic tandem color printer capable of forming a full-color image. However, the image forming apparatus can be a copier, a facsimile machine, a different type of printer, and a multifunction product that combines any or all of the functions of these.

Figure 1:
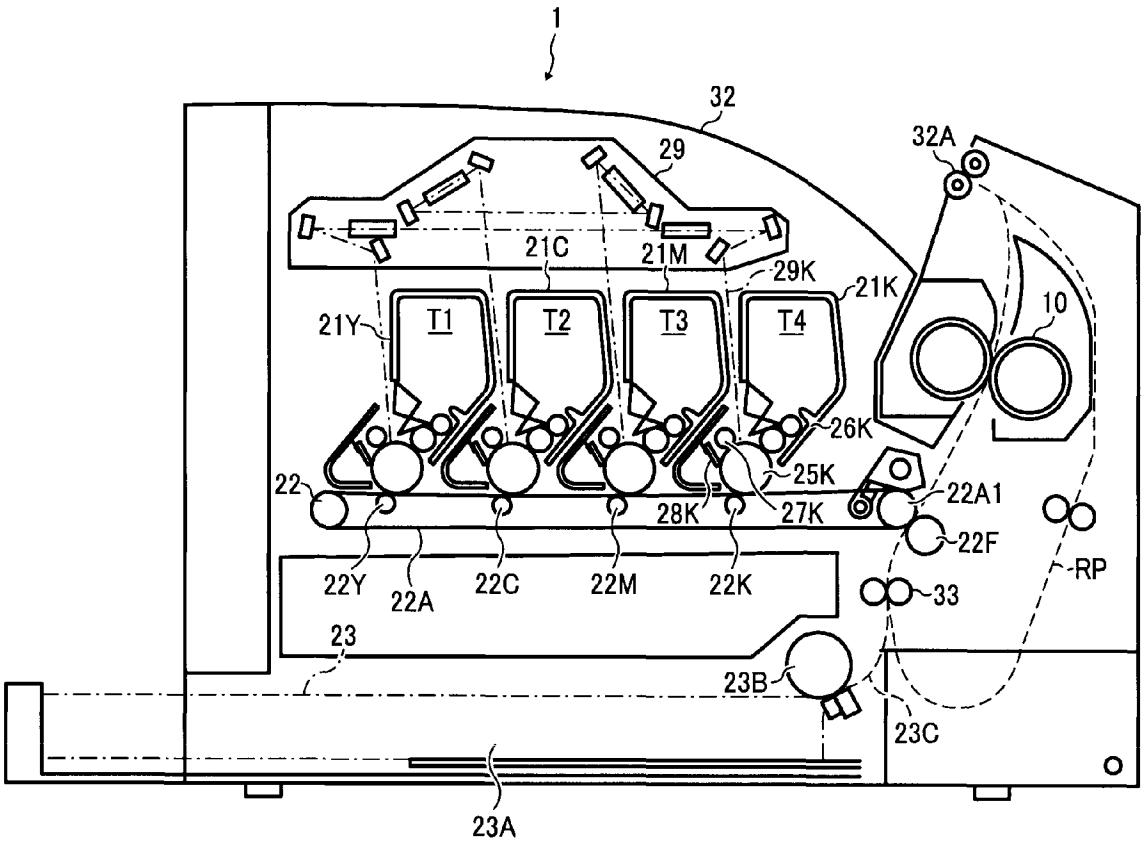
FIG. 1 is a schematic diagram of an image forming apparatus according to an embodiment of the present invention.

FIG. 1 is a schematic diagram of an image forming apparatus 1 according to an embodiment of the present invention. The image forming apparatus 1 includes image forming devices 21Y (yellow), 21C (cyan), 21M (magenta), and 21K (black), a transfer device 22, a feed cassette 23A, registration rollers 33, and a fixing device 10. The image forming devices 21Y, 21C, 21M, and 21K form images of different colors corresponding to an original image. The transfer device 22 is arranged to face the image forming devices 21Y, 21C, 21M, and 21K. The feed cassette 23A is provided in a feeding device 23 for feeding a recording sheet to a transfer area where the image forming devices 21Y, 21C, 21M, and 21K and the transfer device 22 face one another. The registration rollers 33 feed the recording sheet conveyed from the feed cassette 23A synchronously with that the image forming devices 21Y, 21C, 21M, and 21K form images. The fixing device 10 fixes the images transferred onto the recording sheet in the transfer area.

The image forming apparatus 1 further includes a dispensing roller 23B, and a feed path 23C through which a recording sheet is fed by the dispensing roller 23B. Although not shown, the image forming apparatus 1 can include manual feed mechanisms such as a bypass tray.

The fixing device 10 is of heat-roller fusing type, and includes a heat roller and a pressure roller arranged on the opposing sides of the feed path 23C to form a nip therebetween. An image is fused onto a recording sheet by heat and pressure from the rollers while the recording sheet is passing through the nip.

The transfer device 22 includes a transfer belt 22A that extends around a plurality of rollers, and transfer-bias applying units 22Y, 22C, 22M, and 22K arranged to face photosensitive drums. The transfer-bias applying units 22Y, 22C, 22M, and 22K apply a transfer bias to the transfer belt 22A to charge it to a polarity opposite to that of toner. With this, toner images formed by the image forming devices 21Y, 21C, 21M, and 21K are sequentially transferred onto the transfer belt 22A and superimposed thereon. The transfer device 22 also includes a secondary transfer-bias applying unit 22F arranged on the feed path 23C to transfer the toner images superimposed and transferred onto the transfer belt 22A altogether onto a recording sheet.

The image forming devices 21Y, 21C, 21M, and 21K develop yellow, cyan, magenta, and black images, respectively. The image forming devices 21Y, 21C, 21M, and 21K are of like construction except that they use toner of different colors, and thus but one of them, the image forming device 21K, is described below.

The image forming device 21K includes a photosensitive drum 25K as an electrostatic latent image carrier, a charging device 27K, a developing device 26K, and a cleaning device 28K, which are arranged in this order along the rotating direction of the photosensitive drum 25K. A writing device 29 emits writing light to be separated into light of different colors, so that an electrostatic latent image of corresponding color is formed between the charging device 27K and the developing device 26K based on image information. The electrostatic latent image carrier can be in the shape of belt as well as drum. Among the image forming devices, at least the photosensitive drum 25K and a charging roller used for the charging device 27K are provided in a process cartridge 100, as explained later with reference to FIG. 2.

In the image forming apparatus 1, a main motor (not shown) drives and rotates the photosensitive drum 25K at the time of forming an image. After uniformly charged by the charging device 27K, the photosensitive drum 25K is written by writing light 29K. Specifically, the writing device 29 writes an electrostatic latent image on the photosensitive drum 25K with the writing light 29K based on digital image information received from a controller (not shown).

The electrostatic latent image formed on the photosensitive drum 25K is developed into a visible image (toner image) by the developing device 26K with toner of a color corresponding to the one obtained from color separation. For example, a direct current (DC) voltage superimposed with an alternating current (AC) bias is applied to a developing sleeve, so that toner adheres only to portions where the potential decreases owing to the writing light. Thus, a toner image is formed.

A toner image of each color obtained as above is transferred onto a recording sheet that is fed in register timing by the registration rollers 33. It is assumed herein that the developing device is provided with toner supply tanks T1 to T4.

As described above, toner images are electrostatically transferred from the photosensitive drums onto the transfer belt 22A charged with a bias voltage whose polarity is opposite to that of toner by the transfer bias applying units 22Y, 22C, 22M, and 22K at positions opposing the corresponding photosensitive drums. Then, the transferred and superimposed toner images are transferred altogether onto a recording sheet by the secondary transfer-bias applying unit 22F.

The recording sheet with the toner images of all the colors transferred thereonto is self-stripped from the transfer belt 22A by a driving-side roller 22A1 of the transfer device 22, and carried toward the fixing device 10. The fixing device 10 fixes the toner images onto the recording sheet while the recording sheet is passing through the nip between the rollers, and discharges the recording sheet onto an eject tray 32 through discharging rollers 32A that can rotate forward and backward. The discharging rollers 32A function as a switchback carrier at the time of double-sided image forming as discussed below.

The image forming apparatus 1 is capable of forming an image not only on one side of a recording sheet, but also on both sides. When a double-sided image formation is performed, a recording sheet is carried toward the eject tray 32 by the discharging rollers 32A after passing through the fixing device 10, and then the discharging rollers 32A are reversed while holding the trailing edge of the recording sheet. The recording sheet is thereby carried from the side of the eject tray 32 through a reverse circulating path RP to the registration rollers 33 arranged at the position where the circulating path RP meets the feed path 23C from the feed cassette 23A. The recording sheet transporting path is switched between single-sided and double-sided printing by a transporting path changer (not shown) arranged behind the fixing device 10.

Described below is the process cartridge 100 arranged at the image forming position corresponding to the image forming device 21K. The process cartridge 100 is formed of a resin by injection molding. Examples of the resin include polycarbonate resin, acrylonitrile-butadiene-styrene resin, acrylonitrile-styrene resin, styrene resin, polyphenylene ether resin, polyphenylene oxide resin, polyethylene terephthalate resin, and alloy resin thereof.

The process cartridge 100 contains therein the photosensitive drum 25K and the charging roller 27K facing thereto as shown in FIG. 1.

The process cartridge 100 includes a housing extending in parallel with the photosensitive drum 25K and having an inner space to house the above members.

Figure 2:
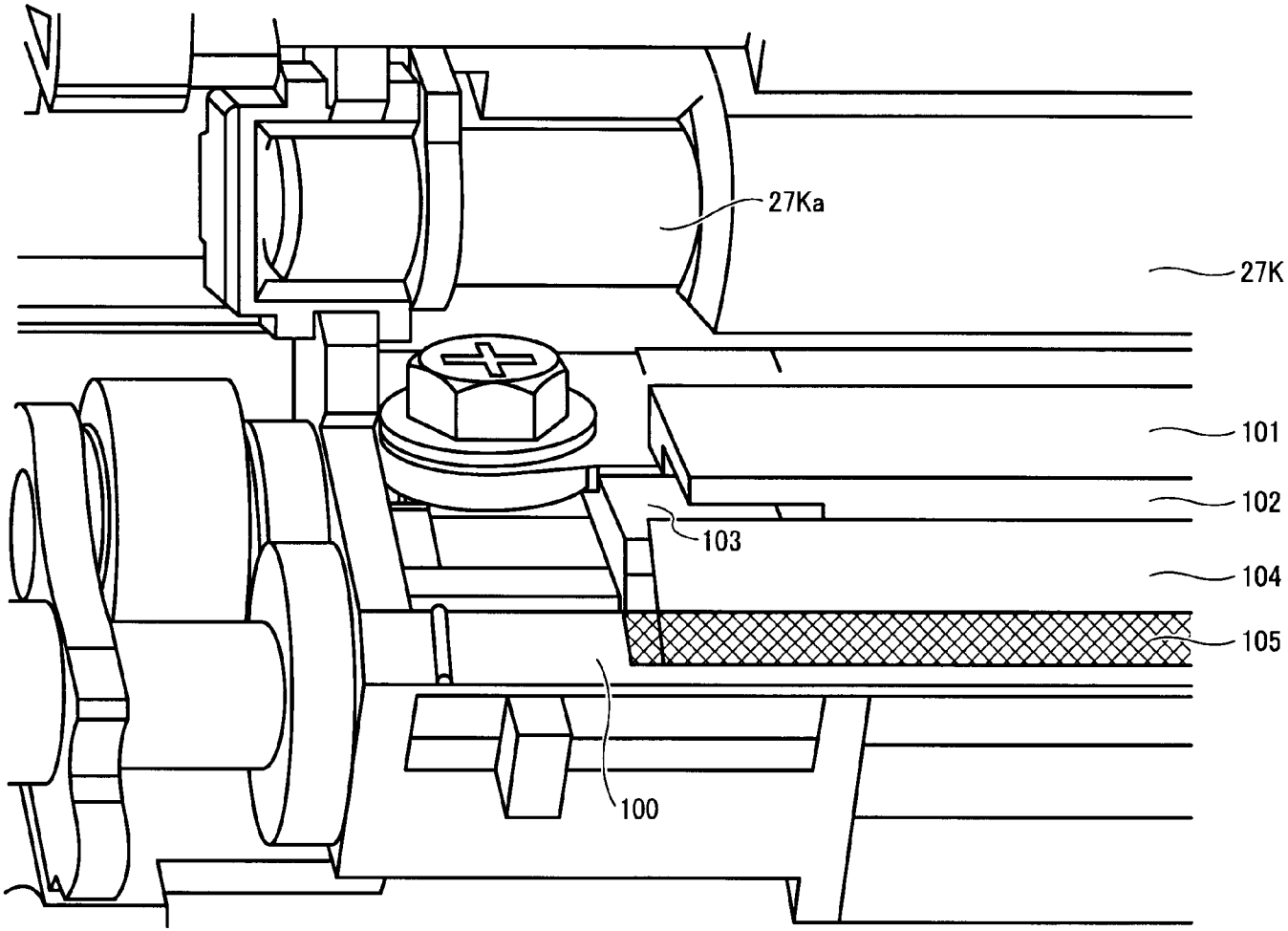
FIG. 2 is a perspective view of a conventional cleaning device.
Figure 3:
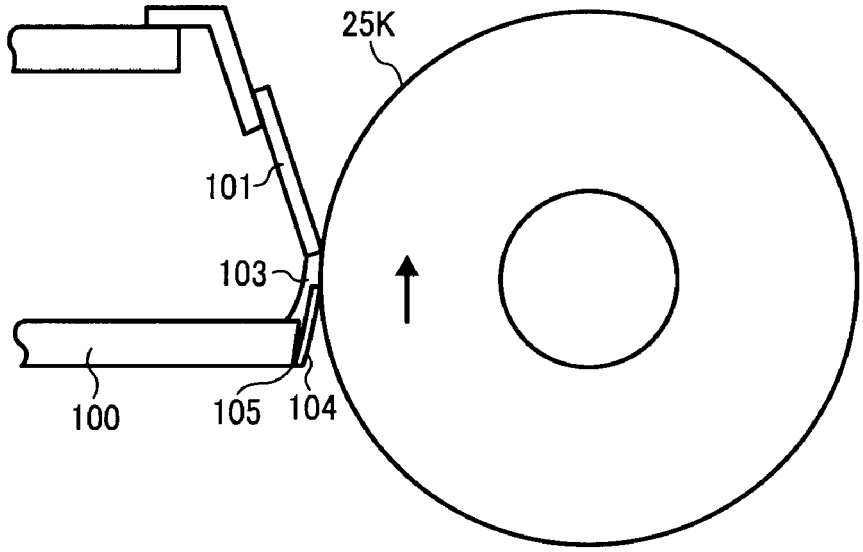
FIG. 3 is a cross-sectional view of the cleaning device shown in FIG. 2.

FIGS. 2 and 3 are schematic diagrams of a conventional cleaning device. The charging roller 27K is formed by shaping a conductive rubber to fit around the circumferential surface of a metal shaft 27Ka. The charging roller 27K adopts a contact electrification system with which the surface of the conductive rubber is brought into contact with the surface of the photosensitive drum to uniformly charge the surface of the photosensitive drum.

In addition, the photosensitive drum has a shaft that extends across the side walls of the housing of the process cartridge 100 with its ends supported by the walls. A gear-equipped flange is provided at one end of the shaft between one of the side walls and the end surface of the photosensitive drum as a positioning member that positions the photosensitive drum at a predetermined place.

The gear-equipped flange is formed integrally with the end surface of the photosensitive drum, and determines the distance to the side wall so that the position of the photosensitive drum is controlled with respect to the direction of thrust. By making use of the installation space, the gear-equipped flange is provided with a gear on its outer circumferential surface to serve as a drive-force transmitting unit for the photosensitive drum. Thus, the gear-equipped flange is given an additional function other than the function of positioning the photosensitive drum in the direction of thrust.

The cleaning device includes a cleaning blade 101 that is screwed onto the housing of the process cartridge 100. An inlet seal 104 is arranged upstream of the cleaning blade 101 with respect to the rotating direction of the photosensitive drum 25K for guiding toner removed from the photosensitive drum 25K to a toner receiving member. The inlet seal 104 can be a resin sheet formed of, for example, polyethylene terephthalate resin, polyurethane resin, polyphenylene ether resin, polycarbonate resin, polyethylene resin, polypropylene resin, or alloy resin thereof.

An opening 102 is formed between the cleaning blade 101 and the inlet seal 104, through which the removed toner is carried. Then, the toner is carried in the longitudinal direction of the cleaning blade 101 by a transporting screw (not shown) or transporting coil and collected into a waste toner tank (not shown). The inlet seal 104 is adhered to the housing of the process cartridge 100 with a double-faced tape 105.

FIG. 3 is a cross-sectional view of an end seal 103. The end seal 103 is pressed against the end portion of the cleaning blade 101 and in contact with the back side of the inlet seal 104 without any gap therebetween to prevent toner leakage from the ends of the cleaning blade 101 and the inlet seal 104 in their longitudinal direction. As shown in FIG. 3, the inlet seal 104 slightly digging into the photosensitive drum 25K is pressed together with the end seal 103 by the photosensitive drum 25K.

Especially at the very end of the inlet seal 104, the line pressure reaches its peak because this portion is sandwiched in between the photosensitive drum 25K and the end seal 103. As the photosensitive drum 25K repeats rotating and stopping operations (rotating in a direction indicated by the arrow in FIG. 3), the inlet seal 104 is gradually pealed off at the interface with the double-faced tape 105 from the very edge thereof. As the repetition of the rotating and stopping operations further proceeds, the end portion of the inlet seal 104 is pealed off in the rotating direction by the friction against the photosensitive drum 25K, resulting in toner leakage. If the amount of leaked toner is negligible and not enough to seep onto the image region, it may not immediately cause a problem. If the toner seeps into the image region, however, image quality is impaired. As the photosensitive drum 25K continues rotating and stopping, the pealed portion of the inlet seal 104 becomes larger. Then, the toner may seep not only into the image region but also spreads over inside the image forming apparatus, smearing the entire apparatus. Once this happens, the defect is so large that the function of the image forming apparatus may no longer be recovered merely by replacing the process cartridge 100 with new one.

Figure 4:
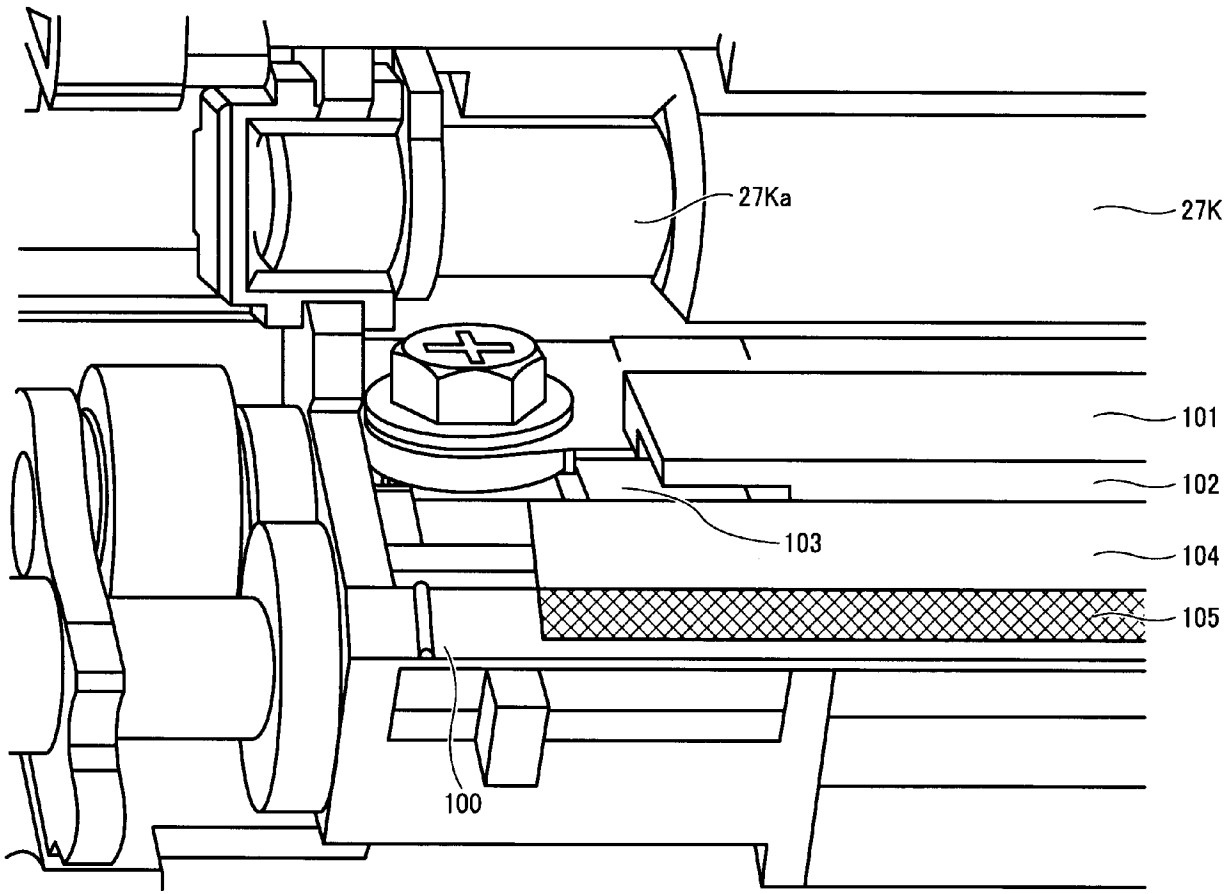
FIG. 4 is a perspective view of an example of a cleaning device of the process cartridge shown in FIG. 1.

FIG. 4 is a perspective view of an example of the cleaning device according to the embodiment. The cleaning device includes the cleaning blade 101 that is screwed onto the housing of the process cartridge 100. The inlet seal 104 is arranged upstream of the cleaning blade 101 with respect to the rotating direction of the photosensitive drum 25K for guiding toner removed from the photosensitive drum 25 to a toner receiving member such as a waste toner container. The toner receiving member and the process cartridge 100 are integrally formed of a resin. The removed toner is carried into the opening 102 provided between the cleaning blade and the inlet seal 104. The toner is then carried in the longitudinal direction of the cleaning blade 101 by a transporting screw (not shown) or a transporting coil (not shown) and collected into a waste toner tank (not shown). The inlet seal 104 is adhered to the housing of the process cartridge 100 with the double-faced tape 105.

The end seal 103 is formed of such a material as foam, non-woven fabric, or woven fabric, and is pressed against the end portion of the cleaning blade 101 and in contact with the back side of the inlet seal 104 without any gap therebetween to prevent toner leakage from the ends of the cleaning blade 101 and the inlet seal 104 in their longitudinal direction.

The inlet seal 104 is configured to cover the end seal 103 and extend out from the end seal 103 in its longitudinal direction. The end portion of the inlet seal 104 that most easily comes off is arranged outside the area between the photosensitive drum 25K and the end seal 103 so that the end portion receives less compressive force from the photosensitive drum 25K than in the portion between the photosensitive drum 25K and the end seal 103. Other portions of the inlet seal 104 sandwiched in between the photosensitive drum 25K and the end seal 103 receives the compressive force in a uniform manner. Thus, an excellent adhesion can be maintained with an adhesive strength of the double-faced tape 105, which prevents the inlet seal 104 from coming off.

Figure 5:
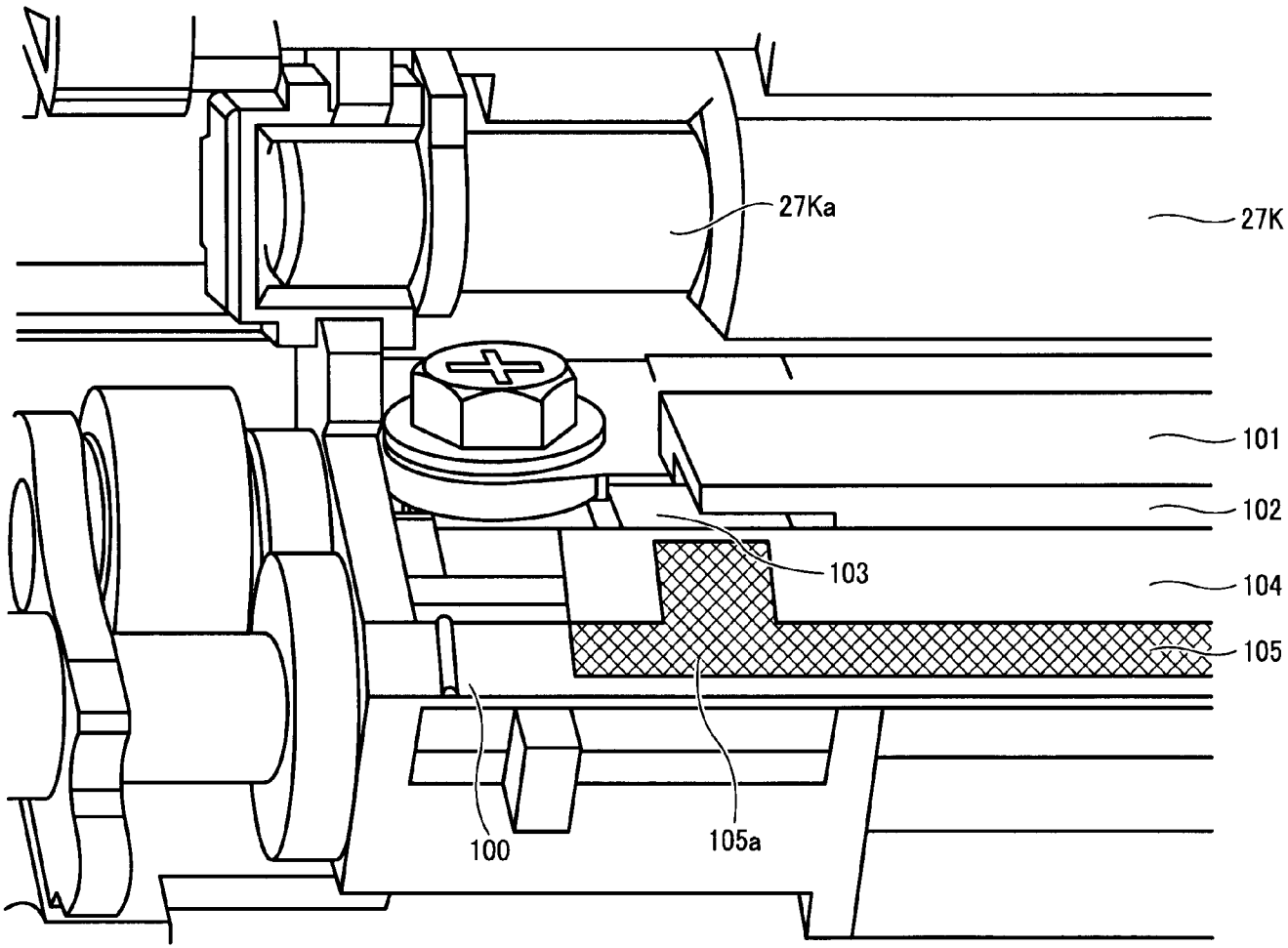
FIG. 5 is a perspective view of another example of the cleaning device.

FIG. 5 is a perspective view of another example of the cleaning device according to the embodiment. As shown in FIG. 5, the double-faced tape 105 is placed not only on the housing of the process cartridge 100, but also on part of the end seal 103. This enhances the adhesion of the portion of the inlet seal 104 interposed between the photosensitive drum 25K and the end seal 103, where the largest peeling force is applied. Hence, the inlet seal 104 has higher tolerance to peeling.

Figure 6:
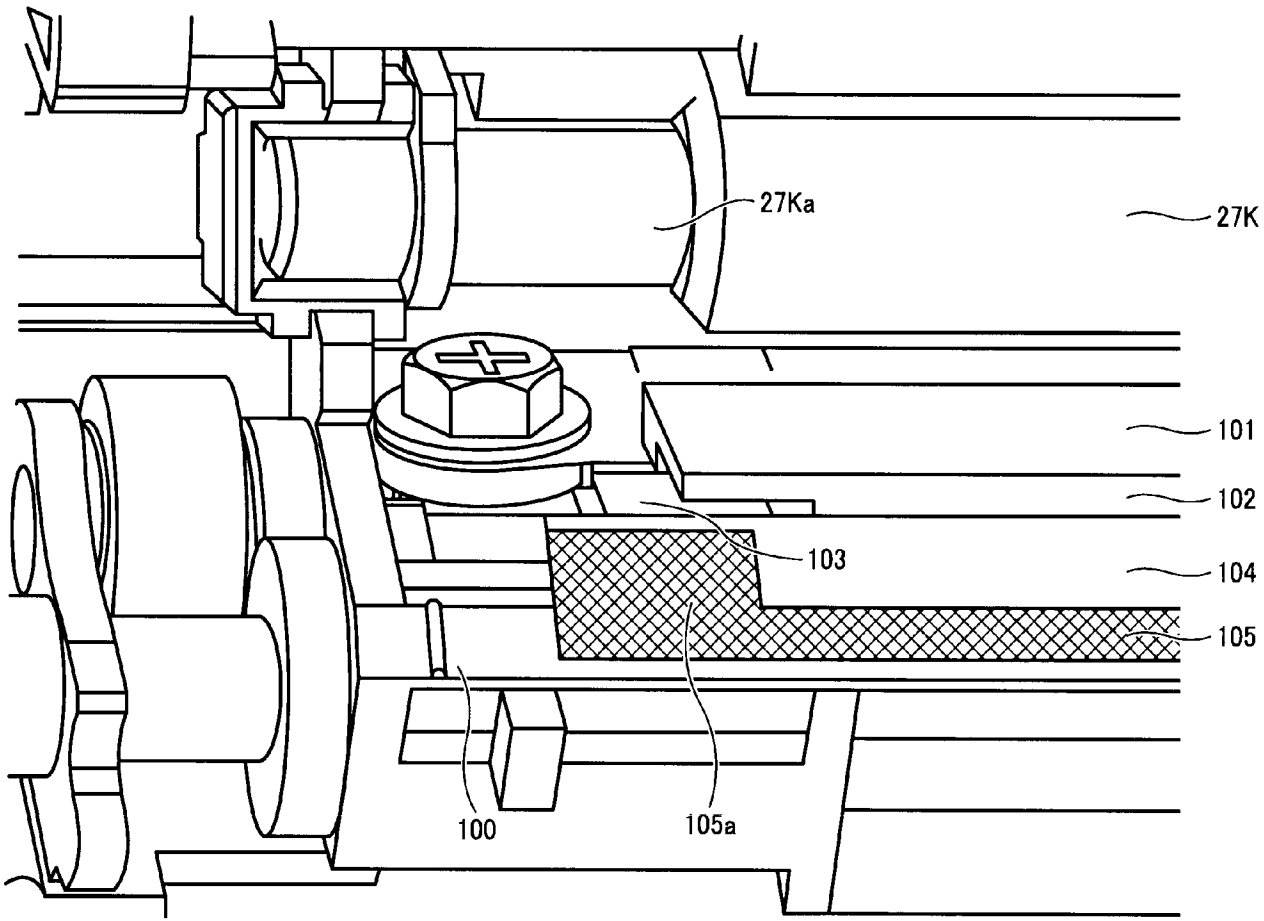
FIG. 6 is a perspective view of still another example of the cleaning device.

FIG. 6 is a perspective view of still another example of the cleaning device according to the embodiment. As shown in FIG. 6, the double-faced tape 105 extends beyond the portion of the end seal 103 to part of the housing to further enhance the adhesion of the portion of the inlet seal 104 interposed between the photosensitive drum 25K and the end seal 103, where the largest peeling force is applied. The tolerance of the inlet seal 104 to peeling is thereby further increased.

Figure 7:
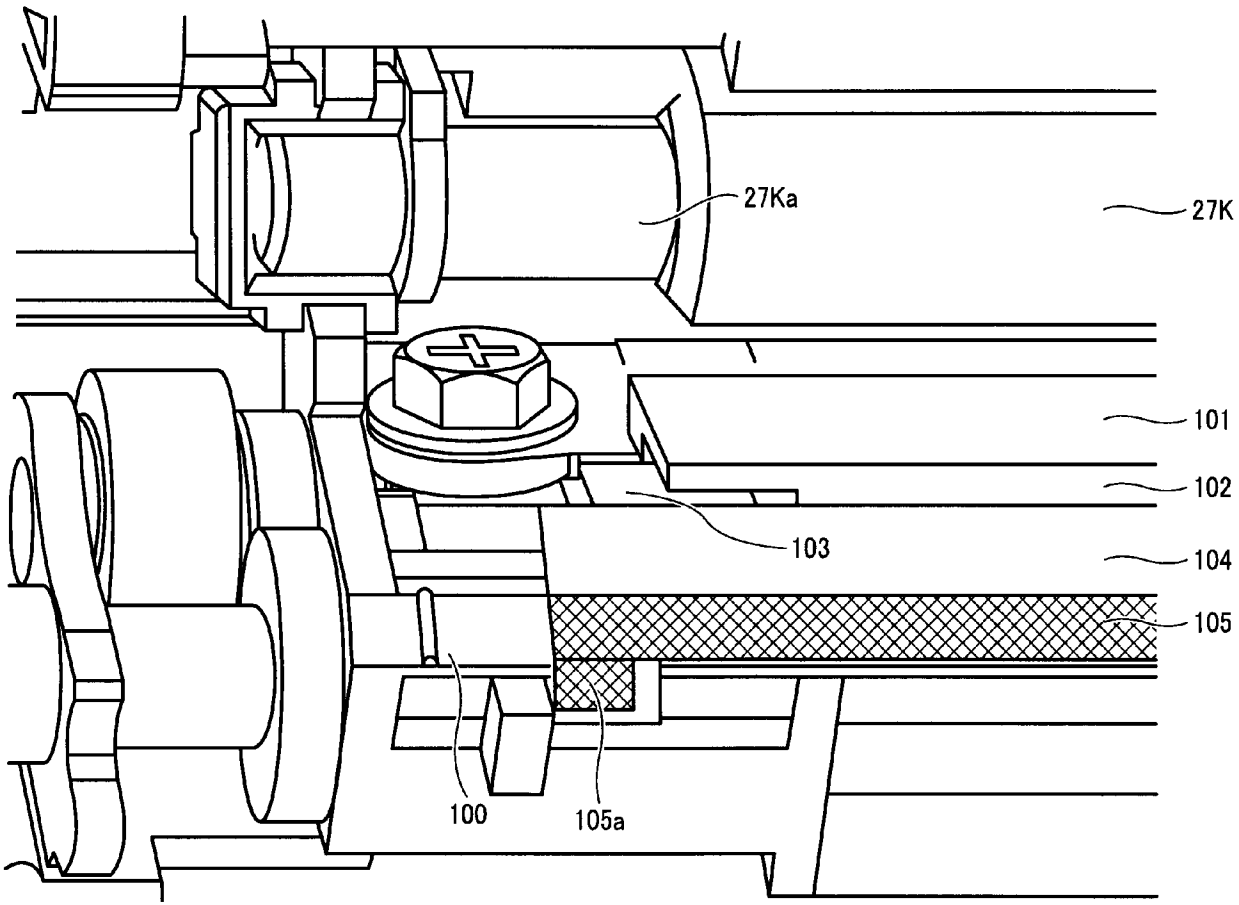
FIG. 7 is a perspective view of still another example of the cleaning device.

FIG. 7 is a perspective view of still another example of the cleaning device according to the embodiment. As shown in FIG. 7, the inlet seal 104 and the double-faced tape 105 are partially extended upstream with respect to the rotating direction of the photosensitive drum 25K in the housing of the process cartridge 100. This ensures the adhesion of the inlet seal 104 against the peeling force that pull the inlet seal 104 due to the rotating and stopping operations of the photosensitive drum 25K.

With the arrangements described above, the inlet seal 104 can be securely adhered, the toner leakage can be prevented, an image excellent in quality can be formed.

As set forth hereinabove, according to an embodiment of the present invention, line pressure applied to the edge of an inlet seal can be reduced. This prevents the inlet seal from peeling off and toner leakage from the ends of the inlet seal.

Moreover, a process cartridge and a toner container are integrally formed of a resin, which results in downsizing the apparatus as well as preventing toner leakage.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaning device comprising:

a cleaning unit that removes residual toner from a surface of an image carrier after a toner image is transferred from the surface; and a housing that houses the cleaning unit, the cleaning unit including a cleaning member that contacts the surface of the image carrier and removes the residual toner, a receiving member that receives the residual toner, a guiding member that guides the residual toner to the receiving member, the guiding member having a length and a width, the length of the guiding member being longer than the width of the guiding member, an end member that is arranged about end portions of the cleaning member and the guiding member, the end member including a first side and a second side parallel to the first side, the guiding member traversing across the first and second sides of the end member in a direction of the length of the guiding member and extending outward from the first and second sides of the end member, and an adhering member that adheres the guiding member to the receiving member.

2. The cleaning device according to claim 1, wherein the receiving member is a toner container that is arranged to face the surface of the image carrier, that has an opening to collect the residual toner, and that is integrally formed with the housing.

3. The cleaning device according to claim 2, wherein the housing is formed of a resin by injection molding.

4. The cleaning device according to claim 3, wherein the resin is selected from a group consisting of polycarbonate resin, acrylonitrile-butadiene-styrene resin, acrylonitrile-styrene resin, styrene resin, polyphenylene ether resin, polyphenylene oxide resin, polyethylene terephthalate resin, and alloy resin thereof.

5. The cleaning device according to claim 1, wherein the adhering member is double-faced tape.

6. The cleaning device according to claim 1, wherein the guiding member is a resin sheet formed of any one of polyethylene terephthalate resin, polyurethane resin, polyphenylene ether resin, polycarbonate resin, polyethylene resin, polypropylene resin, and an alloy resin thereof.

7. The cleaning device according to claim 1, wherein the end member is a sealing member formed of any one of foam, non-woven fabric, and woven fabric.

8. The cleaning device according to claim 1, wherein the adhering member adheres the end member to the receiving member.

9. The cleaning device according to claim 1, wherein an end portion of the guiding member is arranged outside an area between the image carrier and the end member.

10. An image forming apparatus comprising:

an image carrier that rotates;

a charging unit that uniformly charges a surface of the image carrier;

an exposing unit that exposes the surface of the image carrier to patterning light to form an electrostatic latent image on the surface;

a developing unit that develops the electrostatic latent image into a toner image;

an intermediate transfer unit onto which the toner image is transferred from the surface of the image carrier;

a cleaning unit that removes residual toner from the surface of the image carrier after the toner image is transferred from the surface; and a housing that houses the image carrier, the charging unit, the developing unit, and the cleaning unit which are arranged around the image carrier to face the surface of the image carrier, the cleaning unit including a cleaning member that contacts the surface of the image carrier and removes the residual toner, a receiving member that receives the residual toner, a guiding member that guides the residual toner to the receiving member, the guiding member having a length and a width, the length of the guiding member being longer than the width of the guiding member, an end member that is arranged around end portions of the cleaning member and the guiding member, the end member including a first side and a second side parallel to the first side, the guiding member traversing across the first and second sides of the end member in a direction of the length of the guiding member and extending outward from the first and second sides of the end member, and an adhering member that adheres the guiding member to the receiving member.

11. The image forming apparatus according to claim 10, wherein the adhering member adheres the end member to the receiving member.

12. The image forming apparatus according to claim 10, wherein an end portion of the guiding member is arranged outside an area between the image carrier and the end member.

13. The image forming apparatus according to claim 10, wherein the receiving member is a toner container that is arranged to face the surface of the image carrier, that has an opening to collect the residual toner, and that is integrally formed with the housing.

14. A process cartridge comprising:

an image carrier that rotates;

a charging unit that uniformly charges a surface of the image carrier;

a developing unit that develops an electrostatic latent image into a toner image; and a cleaning unit that removes residual toner from the surface of the image carrier after the toner image is transferred from the surface, the cleaning unit including a cleaning member that contacts the surface of the image carrier and removes the residual toner, a receiving member that receives the residual toner, a guiding member that guides the residual toner to the receiving member, the guiding member having a length and a width, the length of the guiding member being longer than the width of the guiding member, an end member that is arranged around end portions of the cleaning member and the guiding member, the end member including a first side and a second side parallel to the first side, the guiding member traversing across the first and second sides of the end member in a direction of the length of the guiding member and extending outward from the first and second sides of the end member, and an adhering member that adheres the guiding member to the receiving member.

15. The process cartridge according to claim 14, wherein the adhering member adheres the end member to the receiving member.

16. The process cartridge according to claim 14, wherein an end portion of the guiding member is arranged outside an area between the image carrier and the end member.

17. The process cartridge according to claim 14, further comprising a housing that houses the image carrier, the charging unit, the developing unit, and the cleaning unit, wherein the receiving member is a toner container that is arranged to face the surface of the image carrier, that has an opening to collect the residual toner, and that is integrally formed with the housing.

* * * * *